US005890976A

United States Patent [19]

Anderson

[11] Patent Number: 5,890,976

[45] Date of Patent: Apr. 6, 1999

[54] ENCASEMENT DEVICE FOR GOLF TEE

[76] Inventor: Jeffrey J. Anderson, 71 Ravine Lake Rd., Bernardsville, N.J. 07924

[21] Appl. No.: 832,761

[22] Filed: Apr. 4, 1997

[51] Int. Cl.[6] ..... A63B 57/00

[52] U.S. Cl. ..... 473/398; 473/401

[58] Field of Search ..... 473/386, 387–403; D21/234; 172/727, 734; 411/439, 462, 481

[56] References Cited

U.S. PATENT DOCUMENTS

| | | | |
|---|---|---|---|
| 2,011,203 | 8/1935 | Seiki | 473/401 |
| 3,114,557 | 12/1963 | Cabot | 473/398 |
| 3,954,263 | 5/1976 | Whelan et al. | 473/401 |
| 4,660,830 | 4/1987 | Tomar | 473/601 |
| 5,016,918 | 5/1991 | Tidwell | 473/387 |
| 5,186,455 | 2/1993 | Rosetta | 473/401 |
| 5,242,161 | 9/1993 | Wilkirson | 473/398 |
| 5,370,388 | 12/1994 | Wehner | 473/386 |
| 5,664,774 | 9/1997 | Walker et al. | 473/600 |

*Primary Examiner*—Steven Wong
*Attorney, Agent, or Firm*—Gibbons, Del Deo, Dolan, Griffinger & Vecchione

[57] ABSTRACT

An encasement device for a golf tee is cylindrically adhered to a shaft of golf tee. The encasement device is a cover with graduated markings, which allows the golfer to consistently set the tee at the golfer's desired depth. Each graduated marking is numerically related to other graduated markings and the ground penetration depth. The resulting multi-layer structure of the golf tee and the encasement device deters breakage of the golf tee and reinforces the shaft structure of the golf tee.

20 Claims, 1 Drawing Sheet

ENCASEMENT DEVICE FOR GOLF TEE

FIELD OF THE INVENTION

This invention relates to the game of golf and in particular, to an encasement device for a golf tee which provides ground depth measurements and deters golf tree breakage.

BACKGROUND OF THE INVENTION

In the game of golf, the tee shot is one of the more important shots. Driving the ball off the tee consistently in terms of range and accuracy is generally a precursor to the golfer's score on the hole and on the course. Many factors contribute to a good tee shot, including proper placement of the feet with respect to the tee, follow through on the tee shot and keeping the head down at time of impact. All of these factors are difficult to master and require multiple rounds of golf and practice sessions.

One factor that should require no practice, is the setting of the golf tee in the ground. However, a drawback of prior art golf tees are that they are not designed to allow the golfer to place the golf tee in the ground at the same depth every time. As a consequence of these poorly designed prior art golf tees, the golfer can not maintain the same body position every time. The golfer has to adjust his or her hands up or down the golf shaft to compensate for the varying height of the golf tee. Unfortunately for the golfer, this inability to consistently place the golf tee at the same height, distracts away from the golfer's ability to concentrate on those factors mentioned above that require focus and practice. Importantly, lack of uniform depth placement of the golf tee prevents hitting the golf ball in the same manner each time, leading to loss of range and accuracy.

Although not solely a consequence of depth misplacement, a further disadvantage of prior art golf tees are there inability to withstand breakage upon impact by the golf club. Since golf tees are normally constructed from wood, golf club impact can result in splintering the golf tee, therefore making it unusable for future tee shots.

Accordingly, there is a need to provide a simple and effective device for a golf tee which provides consistent depth measurements when teeing up golf balls and helps deter the breakage of the golf tees upon impact by the golf club.

SUMMARY OF THE INVENTION

The present invention teaches a device which permits golfers to consistently place the golf tee in the ground, by providing an encasement device for the golf tee which has indicia relating to a desired depth in the ground. Additionally, the encasement device deters breakage of the golf tee by lessening the impact of the golf club on the golf tee and by reinforcing the shaft of the golf tee In an exemplary embodiment of the present invention, an encasement device for a golf tee is cylindrically adhered to a shaft of the golf tee. Advantageously, the present invention encasement device has graduated premeasured marks so as to allow the golfer to consistently set the tee at the golfer's desired depth. The golfer can note the mark on the golf tee which corresponds to the best range and accuracy achieved by the golfer. Consequently, the golfer can use the mark on the next tee shot to attain the proper golf tee depth and concentrate on addressing the golf ball and other such factors.

Advantageously, the encasement device acts as a shock absorber or impact bumper when the golf club impacts on the golf tee. By absorbing or deflecting the energy from the golf club, the present invention deters breakage of the golf tee. The encasement device also acts as a means for reinforcing the shaft structure of the golf tee. Importantly, the above characteristics of the encasement device results in less breakage and extended reuse. The above factors make the present encasement device a simple but effective means for consistent depth placement of the golf tee and still provide breakage deterrence.

BRIEF DESCRIPTION OF THE DRAWINGS

A more complete understanding of the present invention may be obtained from consideration of the following description in conjunction with the drawings in which.

DETAILED DESCRIPTION

The present invention is a device which permits golfers to consistently place the golf tee in the ground, by providing an encasement device for the golf tee which has indicia relating to a desired depth in the ground. This allows the golfer to note the mark on the golf tee which corresponds to the best range and accuracy achieved by the golfer. Consequently, the golfer can use the mark on the next tee shot to attain the proper golf tee depth and concentrate on addressing the golf ball and other such factors. The encasement device deters breakage of the golf tee by lessening the impact of the golf club on the golf tee and by reinforcing the shaft of the golf tee. The encasement device acts as a shock absorber or impact bumper when the golf club impacts on the golf tee. By absorbing or deflecting the energy from the golf club, the present invention deters breakage of the golf tee. The encasement device also acts as a means for reinforcing the shaft structure of the golf tee.

Figure 1:
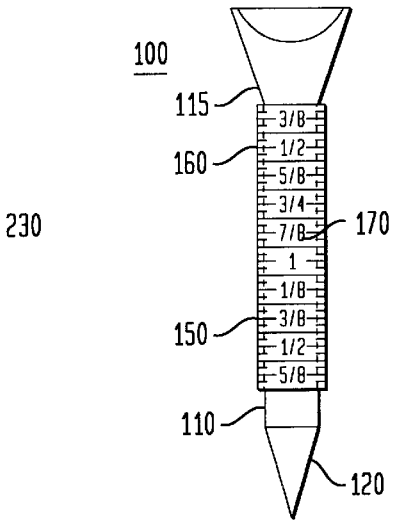
FIG. 1 is a golf tee with an embodiment of an encasement device in accordance with the present invention.

Referring to FIG. 1, there is shown a golf tee 100 with an exemplary embodiment of an encasement device 150 in accordance with the present invention. Golf tee 100 has a shaft portion 110, a head portion 115 connected to an end of shaft portion 110 and a penetrating point portion 120 connected to a remaining end of shaft portion 110. Head portion 120 is configured to hold a golf ball in position for striking by a golf club. Encasement device 150 is comprised of a cover 160, which has graduated markings 170 for indicating ground penetration depth. Graduated markings 170 can be any set of numbers which presents a relative distance between each adjacent graduated marking and the penetration depth distance. For example, as shown in FIG. 1, a fractional number scheme is utilized for the above purposes.

Cover 160 is cylindrically adhered to shaft portion 110 of golf tee 100. That is, cover 160 could have any shape or form, e.g., rectangular sheet or tubular construct, so long as it can cover shaft portion 110, which is normally cylindrically shaped. Cover 160, for example, could be constructed from paper, rubber, metal, mylar, wood, composite materials or other similar substances. Cover 160 could be wrapped around shaft portion 110 by means of cement or other similar adhesive materials. Alternatively, cover 160 could be slipped onto shaft portion 110 and be held in place due to friction. Other means could be used to apply cover 160 to shaft portion 110. For example, cover 160 could be press fit, cast onto, or shrink-wrapped onto shaft portion 110. Cover 160 could also be applied to shaft 110 in the form of a paint, varnish, stain or urethane material. In these instances, the graduated markings could be etched on or by using other similar means.

The combination of golf tee 100 and cover 160 forms at least a double layer structure, which acts as a shock absorber and reinforces the structure of shaft portion 110. This deters breakage of golf tee 100 when a golfer tees off by absorbing or deflecting the incoming energy from the golf club head. In embodiments where an adhesive material is used, a triple layer structure is formed, which further lessens the impact of the golf club on golf tee 100. Since the layered structure decreases the chances of breakage, extended reuse of golf tee 100 is possible.

Figure 2:
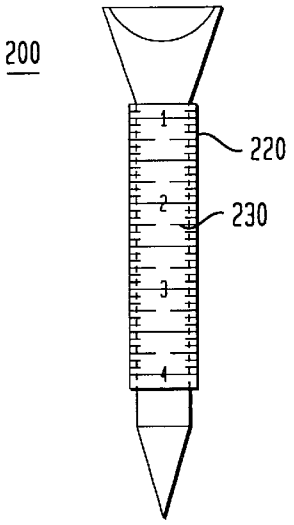
FIG. 2 is a golf tee with another embodiment of an encasement device in accordance with the present invention.
Figure 3:
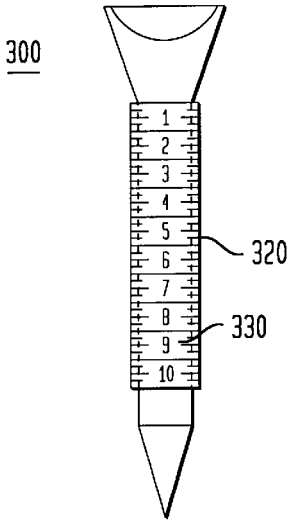
FIG. 3 is a golf tee with another embodiment of an encasement device in accordance with the present invention.

Referring to FIGS. 2 and 3, there is shown two other exemplary embodiments of the present invention. FIG. 2 illustrates a golf tee 200 with an encasement device 220, which has graduated premeasured markings 230 in a metric system relationship. Another exemplary embodiment is shown in FIG. 3 of an encasement device 320 which has graduated premeasured markings 330 in a numerical relational format. Both encasement device 220 and 320 are cylindrically adhered to golf tee 200 and 300, respectively.

Figure 4:
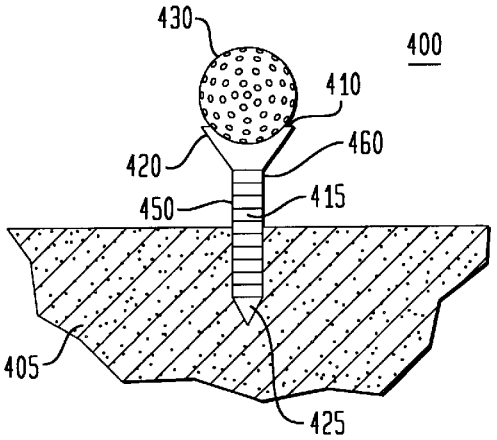
FIG. 4 is an illustrative diagram of a golf ball on a golf tee in accordance with the principles of the invention.

Referring to FIG. 4, there is shown an illustrative playing area 400 which utilizes an encasement device 450 in accordance with the present invention. A golf tee 410 has a shaft portion 415, a head portion 420 and a penetrating point portion 425 formed as shown above. Golf tee 410 has a golf ball 430 teed up on it. Operationally, penetrating point portion 425 is pressed into ground 405 up to a depth desired by the golfer. Prior to striking golf ball 430, the golfer would make note of the depth of golf tee 410 by using graduated markings 460 on encasement device 450. The next time the golfer wants to hit a tee shot, the golfer drives golf tee 410 into ground 405 up to the previously noted graduated marking. In this manner, the golfer will have consistent tee height and can focus on other aspects of the game. As shown above, the present invention is a simple, but effective device which provides the golfer with a consistent golf tee height and increases the chances of reusing the golf tee after teeing off.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications which come within the scope of the appended claim is reserved.

What is claimed:

1. An encasement device, comprising:

a golf tee, said golf tee having a shaft portion, a head portion connected to one end of said shaft portion and a penetrating point portion connected to a remaining end of said shaft portion;

a cover for encasing solely said shaft portion of said golf tee, said cover and said shaft portion of said golf tee forming a double layer structure that deters breakage of said golf tee during use;

means for cylindrically applying said cover solely to said shaft portion, said means for cylindrically applying, said cover and said shaft portion of said golf tee forming a triple layer structure that reinforces said shaft portion against breakage during use of said golf tee; and said cover having graduated premeasured marks for determining a penetrating ground depth of said golf tee.

2. The encasement device according to claim 1, wherein said graduated premeasured marks represent fractional relationships between each adjacent graduated premeasured mark.

3. The encasement device according to claim 1, wherein said graduated premeasured marks represent metric relationships between each adjacent graduated premeasured mark.

4. The encasement device according to claim 1, wherein said graduated premeasured marks represent numbered relationships between each adjacent graduated premeasured mark.

5. The encasement device according to claim 1, wherein said cover is made from a material selected from the group consisting of paper, metal, wood, mylar, plastic, composite and rubber.

6. The encasement device according to claim 1, wherein said cover is made from a material selected from the group consisting of urethane and paint.

7. The encasement device according to claim 1, wherein said means for cylindrically applying said cover to said shaft portion is via a shrink wrap.

8. The encasement device according to claim 1, wherein said means for cylindrically applying said cover to said shaft portion is an adhesive.

9. An apparatus for a golf tee which permits premeasured ground depths and deters breakage of the golf tee, said apparatus comprising:

a sleeve for encasing solely a shaft portion of the golf tee, said sleeve and said shaft portion of the golf tee forming a double layer structure that deters breakage of the golf tee during use;

said sleeve having graduated marks for determining a penetrating depth of the golf tee; and means for cylindrically applying said sleeve solely to said shaft portion, said means for cylindrically applying, said sleeve and said shaft portion of the golf tee forming a triple layer structure that reinforces said shaft portion against breakage during use of the golf tee.

10. The apparatus according to claim 9, wherein said graduated marks represent fractional relationships between each adjacent graduated mark.

11. The apparatus according to claim 9, wherein said graduated marks represent metric relationships between each adjacent graduated mark.

12. The apparatus according to claim 9, wherein said graduated marks represent numbered relationships between each adjacent graduated mark.

13. The apparatus according to claim 9, wherein said means for cylindrically applying is an adhesive material.

14. The apparatus according to claim 9, wherein said sleeve is made from a material selected from the group consisting of paper, metal, wood, mylar, plastic, composite and rubber.

15. A golf tee, comprising:

a shaft portion of the golf tee;

means for encasing solely said shaft portion, said means for encasing and said shaft portion of the golf tee forming a double layer structure that deters breakage of the golf tee during use;

said means for encasing having graduated markings for relating a penetration depth of the golf tee; and means for cylindrically affixing said means for encasing solely to said shaft portion, said means for cylindrically affixing, said means for encasing and said shaft portion of the golf tee forming a triple layer structure that deters breakage of the golf tee and reinforces a structure of said shaft portion.

16. The golf tee according to claim 15, wherein said graduated markings represent fractional relationships between each adjacent graduated marking.

17. The golf tee according to claim 15, wherein said graduated markings represent metric relationships between each adjacent graduated marking.

18. The golf tee according to claim 15, wherein said graduated markings represent numbered relationships between each adjacent graduated marking.

19. The golf tee according to claim 15, wherein said means for encasing is made from a material selected from the group consisting of paper, metal, wood, mylar, plastic, composite and rubber.

20. The golf tee according to claim 15, wherein said means for cylindrically affixing is an adhesive material.

* * * * *